US011053574B2

(12) United States Patent
Yashiki et al.

(10) Patent No.: US 11,053,574 B2
(45) Date of Patent: Jul. 6, 2021

(54) NON-ORIENTED ELECTRICAL STEEL SHEET

(71) Applicant: NIPPON STEEL CORPORATION, Tokyo (JP)

(72) Inventors: Hiroyoshi Yashiki, Tokyo (JP); Yoshiaki Natori, Tokyo (JP); Kazutoshi Takeda, Tokyo (JP); Susumu Mukawa, Tokyo (JP); Takuya Matsumoto, Tokyo (JP); Koji Fujita, Tokyo (JP); Takashi Morohoshi, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 69 days.

(21) Appl. No.: 16/470,122

(22) PCT Filed: Jan. 16, 2018

(86) PCT No.: PCT/JP2018/000981
§ 371 (c)(1),
(2) Date: Jun. 14, 2019

(87) PCT Pub. No.: WO2018/131712
PCT Pub. Date: Jul. 19, 2018

(65) Prior Publication Data

US 2019/0316239 A1 Oct. 17, 2019

(30) Foreign Application Priority Data

Jan. 16, 2017 (JP) ..... JP2017-005212

(51) Int. Cl.
*C22C 38/60* (2006.01)
*C22C 38/00* (2006.01)
(Continued)

(52) U.S. Cl.
CPC ..... *C22C 38/60* (2013.01); *C21D 6/005* (2013.01); *C21D 6/008* (2013.01); *C21D 8/1222* (2013.01);
(Continued)

(58) Field of Classification Search
CPC ..... C21D 6/005; C21D 6/008; C21D 8/12; C21D 8/1222; C21D 8/1233;
(Continued)

(56) References Cited

U.S. PATENT DOCUMENTS 8,097,094 B2 * 1/2012 Murakami ..... C22C 38/004 148/307
2001/0037841 A1 11/2001 Murakami et al.
(Continued)

FOREIGN PATENT DOCUMENTS

CN 1784504 A 6/2006
CN 105132808 A 12/2015
(Continued)

OTHER PUBLICATIONS

Extended European Search Report for counterpart European Application No. 18739441.6, dated May 6, 2020.
(Continued)

*Primary Examiner* — Jenny R Wu
(74) *Attorney, Agent, or Firm* — Birch, Stewart, Kolasch & Birch, LLP

(57) ABSTRACT

A non-oriented electrical steel sheet according to an aspect of the present invention contains, as a chemical composition, by mass %, C: more than 0% and 0.0050% or less, Si: 3.0% to 4.0%, Mn: 1.2% to 3.3%, P: more than 0% and less than 0.030%, S: more than 0% and 0.0050% or less, sol. Al: more than 0% and 0.0040% or less, N: more than 0% and 0.0040% or less, one or more of La, Ce, Pr, and Nd: 0.0005% to 0.0200% in total, Ca: 0.0005% to 0.0100%, Ti: 0.0005% to
(Continued)

0.0100%, Sn: 0% to 0.10%, Sb: 0% to 0.10%, Mg: 0% to 0.0100%, and a remainder including Fe and impurities, in which Si−0.5×Mn: 2.0% or more, and Si+0.5×Mn: 3.8% or more.

5 Claims, 1 Drawing Sheet

(51) Int. Cl.

| | |
|---|---|
| ***C22C 38/14*** | (2006.01) |
| ***C22C 38/04*** | (2006.01) |
| ***C22C 38/06*** | (2006.01) |
| ***C22C 38/02*** | (2006.01) |
| ***C21D 9/46*** | (2006.01) |
| ***C21D 8/12*** | (2006.01) |
| ***C21D 6/00*** | (2006.01) |
| ***H01F 1/147*** | (2006.01) |

(52) U.S. Cl.
CPC ..... *C21D 8/1233* (2013.01); *C21D 8/1261* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/14* (2013.01); *H01F 1/14775* (2013.01); *C22C 2202/02* (2013.01)

(58) Field of Classification Search
CPC .... C21D 8/1261; C21D 9/46; C22C 2202/02; C22C 38/00; C22C 38/001; C22C 38/002; C22C 38/005; C22C 38/008; C22C 38/02; C22C 38/04; C22C 38/06; C22C 38/14; C22C 38/60; H01F 1/14775; H01F 1/16
See application file for complete search history.

(56) References Cited

U.S. PATENT DOCUMENTS

| | | | | |
|---|---|---|---|---|
| 2006/0243351 | A1 | 11/2006 | Ohashi et al. | |
| 2007/0062611 | A1* | 3/2007 | Murakami | C22C 38/04 148/111 |
| 2011/0094699 | A1* | 4/2011 | Miyazaki | C21C 7/0006 164/57.1 |
| 2014/0345751 | A1 | 11/2014 | Oda et al. | |
| 2016/0203896 | A1 | 7/2016 | Nakanishi et al. | |
| 2017/0229222 | A1 | 8/2017 | Nakanishi et al. | |
| 2017/0241002 | A1 | 8/2017 | Nakajima et al. | |
| 2018/0030558 | A1 | 2/2018 | Okubo et al. | |
| 2018/0355454 | A1* | 12/2018 | Okubo | C22C 38/02 |
| 2019/0330708 | A1* | 10/2019 | Okubo | C22C 38/002 |

FOREIGN PATENT DOCUMENTS

| | | | |
|---|---|---|---|
| CN | 105378130 | A | 3/2016 |
| EP | 1679386 | A1 | 7/2006 |
| EP | 1889927 | A1 | 2/2008 |
| EP | 2940160 | A1 | 11/2015 |
| EP | 2940170 | A1 | 11/2015 |
| JP | 2010-24531 | A | 2/2010 |
| JP | 2011-6731 | A | 1/2011 |
| JP | 2015-206092 | A | 11/2015 |
| JP | 2015206092 | A * | 11/2015 |
| JP | 2016-41832 | A | 3/2016 |
| JP | 2016-130360 | A | 7/2016 |
| JP | 2016-138316 | A | 8/2016 |
| JP | 2016-145376 | A | 8/2016 |
| KR | 2003-0054692 | A | 7/2003 |
| WO | WO 2013/046661 | A1 | 4/2013 |
| WO | WO 2016/027565 | A1 | 2/2016 |
| WO | WO 2016/136095 | A1 | 9/2016 |

OTHER PUBLICATIONS

"Methods of measurement of the magnetic properties of electrical steel strip and sheet by means of a single sheet tester", JIS C2556, 2015, total 173 pages.
"Test methods for electrical steel strip and sheet—Part 1: Methods of measurement of the magnetic properties of electrical steel strip and sheet by means of an Epstein frame", JIS C2550-1, 2011, total 97 pages.
International Search Report for PCT/JP2018/000981 dated Apr. 24, 2018.
Office Action for TW 107101551 dated Sep. 21, 2018.
Written Opinion of the International Searching Authority for PCT/JP2018/000981 (PCT/ISA/237) dated Apr. 24, 2018.

* cited by examiner

NON-ORIENTED ELECTRICAL STEEL SHEET

TECHNICAL FIELD OF THE INVENTION

The present invention relates to a non-oriented electrical steel sheet.

Priority is claimed on the basis of Japanese Patent Application No. 2017-005212 filed in Japan on Jan. 16, 2017, the content of which is incorporated herein by reference.

RELATED ART

Recently, global environment issues have been gaining attention, and a demand for efforts for energy saving has been further intensifying. Particularly, in recent years, there has been a strong demand for an increase in efficiency of electrical devices. Therefore, for non-oriented electrical steel sheets that are broadly used as iron core materials of motors, power generators, transformers, or the like, a demand for improving magnetic properties has been further intensifying. In recent years, for motors, power generators for electrical vehicles, or hybrid vehicles, and motors for compressors for which an increase in efficiency progresses, the above-described tendency is significant.

In order to improve the magnetic properties of the non-oriented electrical steel sheets, it is effective to add alloying elements to steel, thereby increasing electrical resistance of steel sheets and decreasing eddy-current loss. Therefore, for example, as disclosed in Patent Document 1 and Patent Document 2, the improvement of the magnetic properties (a decrease in iron loss, an increase in density of magnetic flux, and the like) is achieved by adding an element having an effect of increasing electrical resistance such as Si, Al, or Mn.

PRIOR ART DOCUMENTS

Patent Documents

[Patent Document 1] PCT International Publication No. WO2016/027565

[Patent Document 2] Japanese Unexamined Patent Application, First Publication No. 2016-130360

[Patent Document 3] PCT International Publication No. WO2016/136095

DISCLOSURE OF THE INVENTION

Problems to be Solved by the Invention

In a case where it is considered the alloying elements in the same amount (mass %) is added, except for P having a significant adverse influence on cold rollability, Si is an effective element for easily increasing the electrical resistance and decreasing the iron loss. Therefore, Patent Document 1 discloses that Si content is set to 6 mass % or less, Patent Document 2 discloses that the Si content is set to 5.0 mass % or less, and Patent Document 3 discloses that the Si content is set to 8.0 mass % or less.

In addition, Patent Document 1 and Patent Document 2 disclose that Al content is set to 0.0050% or less, and the electrical resistance is increased using Si and Mn, thereby decreasing the iron loss.

However, as a result of studies, the inventors found that a decrease in a high-frequency iron loss such as $W_{10/400}$ is not sufficient, in the steel sheets described in Patent Document 1 to Patent Document 3. The reason therefor is considered that high alloying is indispensable to decrease the high-frequency iron loss; however, in Patent Document 1 to Patent Document 3, the high-frequency iron loss is not studied, and the lower limit values of amounts of alloys necessary for the decrease in the high-frequency iron loss or a distribution of appropriate addition amounts of Si, Al, and Mn are not taken into account. Therefore, the decrease in the high-frequency iron loss such as $W_{10/400}$ not sufficient.

The present invention has been made in consideration of the above-described problem. An object of the present invention is to provide a non-oriented electrical steel sheet which has favorable cold rollability and is excellent in magnetic properties, particularly, high-frequency iron loss.

Means for Solving the Problem

In order to achieve the above-described object, the present inventors carried out intensive studies. As a result, the present inventors found that magnetic properties can be improved by preventing the degradation of a grain growth property while ensuring favorable cold rollability by (i) setting Al content to be equal to or less than a predetermined value, (ii) adding Mn which contributes to an increase in electrical resistance and has a small adverse influence on cold rollability together with Si, and (iii) further adding one or more of La, Ce, Pr, and Nd and Ti, and completed the present invention.

The gist of the present invention completed on the basis of the above-described finding is as described below.

(1) A non-oriented electrical steel sheet according to an aspect of the present invention contains, as a chemical composition, by mass %, C: more than 0% and 0.0050% or less, Si: 3.0% to 4.0%, Mn: 1.2% to 3.3%, P: more than 0% and less than 0.030%, S: more than 0% and 0.0050% or less, sol. Al: more than 0% and 0.0040% or less, N: more than 0% and 0.0040% or less, one or more of La, Ce, Pr, and Nd: 0.0005% to 0.0200% in total, Ca: 0.0005% to 0.0100%, Ti: 0.0005% to 0.0100%, Sn: 0% to 0.10%, Sb: 0% to 0.10%, Mg: 0% to 0.0100%, and a remainder including Fe and impurities, in which Si−0.5×Mn: 2.0% or more, and Si+0.5×Mn: 3.8% or more.

(2) The non-oriented electrical steel sheet according to (1) may contain, as the chemical composition, one or two selected from the group consisting of Sn: 0.005% to 0.10% and Sb: 0.005% to 0.10%.

(3) The non-oriented electrical steel sheet according to (1) or (2) may contain, as the chemical composition, Mg: 0.0005% to 0.0100%.

Effects of the Invention

According to the above-described aspect of the present invention, a non-oriented electrical steel sheet having favorable cold rollability and excellent magnetic properties can be obtained.

EMBODIMENTS OF THE INVENTION

Hereinafter, a preferred embodiment of the present invention will be described in detail with reference to drawings.

In the present specification and the drawings, constitutional elements having substantially the same functional constitution will be given the same reference symbol and a duplicate description will not be provided.

(Regarding Non-Oriented Electrical Steel Sheet)

In non-oriented electrical steel sheets, as described in advance, in order to decrease high-frequency iron loss, generally, alloying elements are added to steel, thereby increasing electrical resistance of the steel sheets and decreasing eddy-current loss. Here, in a case where it is considered that the alloying elements in the same amount (mass %) are added, Si easily increases the electrical resistance and is thus an effective element for decreasing iron loss. However, as a result of the present inventors' studies, it has been clarified that the cold rollability of non-oriented electrical steel sheets is significantly degraded, in a case where the Si content exceeds 4.0 mass %.

In addition, similar to Si, Al is also an alloying element that exhibits an effect of increasing the electrical resistance. However, as a result of the present inventors' studies, it has been clarified that Al also, similar to Si, degrades the cold rollability. In addition, when the Al content increases, there is a tendency that hysteresis loss is deteriorated and the magnetic properties are degraded. Therefore, it is difficult to add a large amount of Al to the non-oriented electrical steel sheet as an alloying element. In non-oriented electrical steel sheets, in order to suppress the degradation of the magnetic properties due to the deterioration of hysteresis loss, it is preferably that the Al content is set to be small. On the other hand, as a result of present inventor's intensive studies, it also has been clarified that the grain growth property is degraded and the magnetic properties are degraded in steel in which the Al content is decreased.

The present inventors carried out intensive studies regarding a method which is capable of suppressing the degradation of a grain growth property and improves both the cold rollability and the magnetic properties, even in a case where the Al content is decreased. As a result, it has been found that it is effective to add Mn having a small adverse influence on the cold rollability together with Si and, furthermore, compositively add one or more of La, Ce, Pr, and Nd and Ti.

Hereinafter, a non-oriented electrical steel sheet according to an embodiment of the present invention (the non-oriented electrical steel sheet according to the present embodiment) will be described in detail with reference to FIG. 1.

Figure 1:
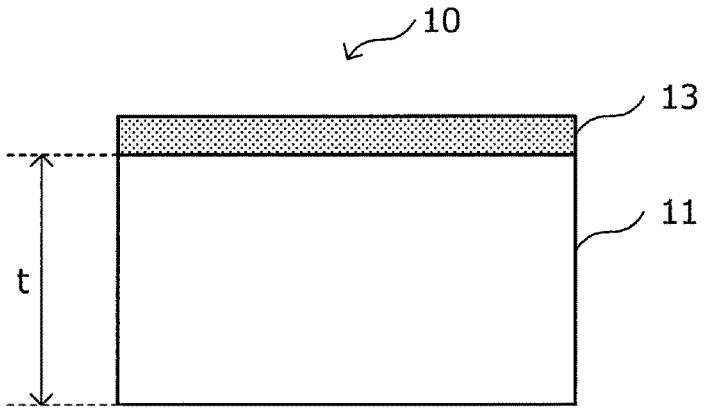
FIG. 1 is a view schematically showing a structure of a non-oriented electrical steel sheet according to an embodiment of the present invention.

FIG. 1 is a view schematically showing the structure of the non-oriented electrical steel sheet according to the embodiment of the present invention. A non-oriented electrical steel sheet 10 according to the present embodiment has a base 11 having a predetermined chemical composition, as schematically shown in FIG. 1. The non-oriented electrical steel sheet according to the present embodiment may consist of the base 11 alone, but preferably further has an insulating coating 13 on a surface of the base 11.

Hereinafter, first, the base 11 in the non-oriented electrical steel sheet 10 according to the present embodiment will be described in detail.

<Regarding Chemical Composition of Base>

The base 11 in the non-oriented electrical steel sheet 10 according to the present embodiment contains, by mass %, C: more than 0% and 0.0050% or less, Si: 3.0% to 4.0%, Mn: 1.2% to 3.3%, P: more than 0% and less than 0.030%, S: more than 0% and 0.0050% or less, sol. Al: more than 0% and 0.0040% or less, N: more than 0% and 0.0040% or less, one or more of La, Ce, Pr, and Nd: 0.0005% to 0.0200% in total, Ca: 0.0005% to 0.0100%, Ti: 0.0005% to 0.0100%, Sn: 0% to 0.10%, Sb: 0% to 0.10%, Mg: 0% to 0.0100%, and a remainder consisting of Fe and impurities, when a value represented by "Si+0.5×Mn" is calculated using the Si content and the Mn content, the value is 3.8% or more, and when a value represented by "Si−0.5×Mn" is calculated using the Si content and the Mn content, the value is 2.0% or more.

In addition, the base 11 in the non-oriented electrical steel sheet 10 according to the present embodiment preferably contains at least one selected from the group consisting of Sn: 0.005% to 0.10% and Sb: 0.005% to 0.10%.

In addition, the base 11 in the non-oriented electrical steel sheet 10 according to the present embodiment preferably contains Mg: 0.0005% to 0.0100%.

Hereinafter, the reasons for regulating the chemical composition of the base 11 according to the present embodiment as described above will be described in detail. Hereinafter, unless otherwise noted, "%" regarding the chemical composition indicates "mass %".

[C: More than 0% and 0.0050% or Less]

Carbon (C) is an element that is inevitably contained and an element causing a deterioration in iron loss (an increase in iron loss). In a case where the C content exceeds 0.0050%, the deterioration in iron loss occurs in the non-oriented electrical steel sheet, and it is not possible to obtain favorable magnetic properties. Therefore, in the non-oriented electrical steel sheet according to the present embodiment, the C content is set to 0.0050% or less. The C content is preferably 0.0040% or less and more preferably 0.0030% or less.

The smaller the C content is, the more preferable. However, C is an element that is inevitably contained, and the lower limit is set to more than 0%. In addition, when it attempts to decrease the C content to be less than 0.0005%, the cost is significantly increased. Therefore, the C content may be set to 0.0005% or more.

[Si: 3.0% to 4.0%]

Silicon (Si) is an element that increases the electrical resistance of steel, thereby decreasing eddy-current loss and improving high-frequency iron loss. In addition, Si has a great capability of solid solution strengthening and is thus an effective element for the high-strengthening of the non-oriented electrical steel sheet. In the non-oriented electrical steel sheet, the high-strengthening is required from the viewpoint of suppression of deformation or suppression of fatigue fracture during the high-speed rotation of motors. In order to make the above-described effect sufficiently exhibited, it is necessary that the Si content is set to 3.0% or more. The Si content is preferably 3.1% or more and more preferably 3.2% or more.

Meanwhile, in a case where the Si content exceeds 4.0%, the workability is significantly deteriorated, and it becomes difficult to carry out cold rolling or the steel sheet breaks during cold rolling (that is, the cold rollability is degraded). Therefore, the Si content is set to 4.0% or less. The Si content is preferably 3.9% or less and more preferably 3.8% or less.

[Mn: 1.2% to 3.3%]

Manganese (Mn) is an effective element for increasing the electrical resistance, thereby decreasing eddy-current loss and improving high-frequency iron loss. In addition, Mn is an element that has a smaller capability of the solid solution strengthening than Si, but does not deteriorate the workability, and is capable of contributing to the high-strengthening. In order to make the above-described effect sufficiently exhibited, it is necessary that the Mn content is set to 1.2% or more. The Mn content is preferably 1.3% or more, more preferably 1.4% or more, and still more preferably 1.5% or more.

Meanwhile, in a case where the Mn content exceeds 3.3%, the density of magnetic flux is significantly decreased. Therefore, the Mn content is set to 3.3% or less. The Mn content is preferably 3.2% or less, more preferably 3.1% or less, and more preferably 3.0% or less.

[P: More than 0% and Less than 0.030%]

Phosphorus (P) is an element that significantly deteriorates the workability and makes cold rolling difficult, in high alloy steel where the Si content and the Mn content are large. Therefore, the P content is set to less than 0.030%. The P content is preferably 0.020% or less and more preferably 0.010% or less.

The smaller the P content is, the more preferable. However, P is an element that is inevitably contained, and the lower limit is set to more than 0%. When the P content is set to less than 0.001%, a significant increase in cost is caused. Therefore, the lower limit is preferably set to 0.001% or more and more preferably 0.002% or more.

[S: More than 0% and 0.0050% or Less]

Sulfur (S) is an element that is inevitably contained. In addition, S is an element that increases iron loss by forming fine precipitates of MnS and deteriorates the magnetic properties of the non-oriented electrical steel sheet. Therefore, it is necessary that the S content is set to 0.0050% or less. The S content is preferably 0.0040% or less and more preferably 0.0035% or less.

The smaller the S content is, the more preferable. However, S is an element that is inevitably contained, and the lower limit is set to more than 0%. When it attempts to decrease the S content to be less than 0.0001%, the cost is significantly increased. Therefore, the S content is preferably set to 0.0001% or more.

[Sol. Al: More than 0% and 0.0040% or Less]

Aluminum (Al) is an element that increases the electrical resistance of the non-oriented electrical steel sheet, thereby decreasing eddy-current loss and improving high-frequency iron loss, when forming a solid solution in steel. However, in the non-oriented electrical steel sheet according to the present embodiment, rather than Al, Mn which is an element that increases the electrical resistance without deteriorating the workability is more actively contained. Therefore, it is not necessary to actively contain Al. In addition, when the amount of sol. Al (acid-soluble Al) exceeds 0.0040%, a fine nitride is precipitated in steel, grain growth during annealing hot-rolled sheet or final annealing is impaired, and the magnetic properties are deteriorated. Therefore, the amount of sol. Al is set to 0.0040% or less. The amount of sol. Al is preferably 0.0030% or less and more preferably 0.0020% or less.

Meanwhile, Al is an element that is inevitably contained, and the lower limit is set to more than 0%. When it attempts to decrease the amount of sol. Al to be less than 0.0001%, the cost is significantly increased. Therefore, the amount of sol. Al may be set to 0.0001% or more.

[N: More than 0% and 0.0040% or Less]

Nitrogen (N) is an element that is inevitably contained. In addition, N is an element that increases iron loss by forming a fine nitride in steel and deteriorates the magnetic properties of the non-oriented electrical steel sheet. Therefore, it is necessary that the N content is set to 0.0040% or less. The N content is preferably 0.0030% or less and more preferably 0.0020% or less.

Meanwhile, N is an element that is inevitably contained, and the lower limit is set to more than 0%. In addition, the smaller the N content is, the more preferable. When it attempts to decrease the N content to be less than 0.0001%, the cost is significantly increased. Therefore, the N content may be set to 0.0001% or more. The N content is more preferably 0.0003% or more.

[Ti: 0.0005% to 0.0100%]

Titanium (Ti) is inevitably contained in the raw material of Mn or Si. Ti is an element that bonds with C, N, O, or the like in the base, forms a fine precipitate such as TiN, TiC, or a Ti oxide, impairs the growth of grains during annealing, and deteriorates the magnetic properties. Therefore, in the related art, in order to extremely decrease the Ti content in the base, a highly purified Mn or Si was used as raw materials.

However, as a result of the present inventors' studies, it has been clarified that the grain growth property can be held without impairing the growth of grains during annealing by compositively adding one or more of La, Ce, Pr, and Nd, which will be described below, together with Ti. The reason therefor is not clear, but is considered that the generated fine precipitate such as TiN, TiC, or a Ti oxide unites with a compound of one or more of La, Ce, Pr, and Nd, is coarsened, and becomes a larger precipitate that does not impair the growth of grains. That is, it is considered that the generation of a coarse precipitate decreases the fine precipitate that impairs grain growth and suppresses the degradation of the grain growth property.

Furthermore, in the related art, in order to extremely decrease the Ti content in the base, it has attempted to increase the purity of the raw material, but the adverse influence of Ti can be avoided by adding one or more of La, Ce, Pr, and Nd, and thus an excessive increase in the purification of the raw material is not necessarily required. As a result, it becomes possible to manufacture a non-oriented electrical steel sheet having higher performance at a lower cost.

In the non-oriented electrical steel sheet according to the present embodiment, one or more of La, Ce, Pr, and Nd are added, whereby the grain growth property can be ensured even when Ti is mixed into the non-oriented electrical steel sheet from the raw material. Therefore, an excessive increase in the purity of the raw material is not necessarily required. From the viewpoint of the cost, the use of raw material of Mn or Si containing Ti is considered, and the Ti content is set to 0.0005% or more. However, in a case where the Ti content exceeds 0.0100%, it becomes difficult to prevent the adverse influence of Ti even when the maximum permissible amount of one or more of La, Ce, Pr, and Nd are added. Therefore, the Ti content is set to 0.0005% or more and 0.0100% or less. In order to more reliably exhibit the improvement effect of the grain growth property by compositively adding one or more of La, Ce, Pr, and Nd and achieve cost reduction, the Ti content is preferably 0.0015% or more and 0.0080% or less and more preferably 0.0025% or more and 0.0060% or less.

[One or More of La, Ce, Pr, and Nd: 0.0005% to 0.0200% in Total]

La, Ce, Pr, and Nd are elements that bond with S and form coarse sulfides and/or coarse sulfur oxides, thereby suppressing the precipitation of fine MnS and accelerating the grain growth during annealing. Furthermore, La, Ce, Pr, and Nd are elements that compositively precipitate the fine precipitate such as TiN, TiC, or a Ti oxide which is generated due to Ti in the coarse sulfide and/or the coarse sulfur oxide, improve the grain growth property, and improve the magnetic properties. In order to obtain the above-described effects, it is necessary that the amount of one or more of La, Ce, Pr, and Nd is set to 0.0005% or more in total. On the other hand, in a case where the amount of one or more of La, Ce, Pr, and Nd exceeds 0.0200% in total, the above-described fine precipitate coarsening effect is saturated, which causes an economic disadvantage, it is not preferable. Therefore, the amount of one or more of La, Ce, Pr, and Nd is set to 0.0200% or less in total. The amount of one or more of La, Ce, Pr, and Nd is preferably 0.0010% or more and 0.0150% or less in total and more preferably 0.0020% or more and 0.0100% or less in total.

[Ca: 0.0005% to 0.0100%]

Calcium (Ca) is an element that bonds with S and forms a coarse compound, thereby suppressing the precipitation of fine MnS and accelerating grain growth during annealing. Furthermore, Ca is an effective element for avoiding nozzle blocking caused by an oxide during continuous casting when compositively contained with one or more of La, Ce, Pr, and Nd. In order to obtain the above-described effects, it is necessary that the Ca content is set to 0.0005% or more and is preferably 0.0010% or more.

On the other hand, in a case where the Ca content exceeds 0.0100%, the improvement effect of the above-described grain growth property or the suppression effect of the nozzle blocking is saturated, which causes an economic disadvantage. The Ca content is preferably set to 0.0100% or less. The Ca content is preferably 0.0080% or less and more preferably 0.0060% or less.

[Sn: 0% to 0.10%]

[Sb: 0% to 0.10%]

Tin (Sn) and antimony (Sb) are useful elements that ensure a low iron loss by segregating on the surface and suppressing oxidation or nitriding during annealing. Therefore, in the non-oriented electrical steel sheet according to the present embodiment, in order to obtain the above-described effect, at least any one of Sn or Sb may be contained in the base. In order to sufficiently exhibit the above-described effect, the amount of Sn or Sb is preferably 0.005% or more and more preferably 0.010% or more.

On the other hand, in a case where the amount of Sn or Sb exceeds 0.10%, there is a possibility that the ductility of the base degrades and cold rolling becomes difficult. Therefore, even in a case where Sn or Sb is contained, the amount of Sn or Sb is preferably set to 0.10% or less and more preferably 0.05% or less.

Sn and Sb are arbitrary elements and do not necessarily need to be contained, and the lower limits are 0%.

[Mg: 0% to 0.0100%]

Magnesium (Mg) bonds with S and forms a coarse compound. When a coarse compound of Mg and S is formed, the precipitation of fine MnS is suppressed, and grain growth during annealing is accelerated, which is advantageous to ensuring a low iron loss. Therefore, in the non-oriented electrical steel sheet according to the present embodiment, in order to obtain the above-described effect, Mg may be added. In order to sufficiently exhibit the effect, the Mg content is preferably set to 0.0005% or more. On the other hand, in a case where the Mg content exceeds 0.0100%, the improvement effect of the above-described grain growth property is saturated, which causes an economic disadvantage, it is not preferable. Therefore, the Mg content is preferably set to 0.0100% or less. In a case where Mg is added to the base, the Mg content is more preferably 0.0050% or less Mg is an arbitrary element and does not necessarily need to be contained, and thus the lower limit is 0%.

The non-oriented electrical steel sheet according to the present embodiment basically includes the above-described elements with the remainder consisting of Fe and impurities. However, the non-oriented electrical steel sheet according to the present embodiment may further contain, in addition to the above-described elements, elements such as nickel (Ni), chromium (Cr), copper (Cu), and molybdenum (Mo). When the above-described elements are contained in an amount of 0.50% or less respectively, the effect of the non-oriented electrical steel sheet according to the present embodiment is not impaired.

In addition, the non-oriented electrical steel sheet may further contain, in addition to the above-described elements, elements such as lead (Pb), bismuth (Bi), vanadium (V), arsenic (As), and boron (B). When the above-described elements are contained in an amount of 0.0050% or less respectively, the effect of the non-oriented electrical steel sheet according to the present embodiment is not impaired.

In the non-oriented electrical steel sheet according to the present embodiment, once the amounts of the respective elements are controlled as described above, it is necessary to control the Si content and the Mn content so as to satisfy a predetermined relationship.

[Si+0.5×Mn: 3.8% or More]

In a case where iron loss, particularly, a high-frequency iron loss such as $W_{10/400}$ which is a target of the non-oriented electrical steel sheet according to the present embodiment is decreased (improved), it is effective to increase the electrical resistance of the steel sheet by highly alloying the steel sheet. Specifically, when Si and Mn are added so that Si+0.5×Mn becomes 3.8% or more, it is possible to further decrease the high-frequency iron loss. Therefore, Si+0.5×Mn is set to 3.8% or more. Si+0.5×Mn is preferably 3.9% or more, more preferably 4.0% or more, and still more preferably 4.4% or more.

The substantial upper limit of Si+0.5×Mn is a value that is calculated from the upper limits of Si and Mn.

[Si−0.5×Mn: 2.0% or More]

In the non-oriented electrical steel sheet according to the present embodiment, the contained La, Ce, Pr, Nd, and Ca fix S as a sulfide or an oxysulfide. In this case, the oxidation or nitriding of the surface of the steel sheet is accelerated, and there is a concern that the magnetic properties may degrade.

However, when Si−0.5×Mn is set to 2.0 or less, it is possible to suppress the degradation of the magnetic properties. The reason therefor is not clear, but it is considered that, when Si−0.5×Mn is set to 2.0 or less, a thin oxidation layer of fine $SiO_2$ is likely to be generated on the surface of the steel sheet during heating for final annealing, and oxidation or nitriding is suppressed in the soaking process of final annealing.

In addition, Si is an element for accelerating formation of ferrite phase (that is, ferrite former element). On the other hand, Mn is an element for accelerating formation of austenite phase (that is, austenite former element). Therefore, the metallographic structure of the non-oriented electrical steel sheet changes depending on the respective amounts of Si and Mn, the non-oriented electrical steel sheet becomes the alloy system having a transformation point or becomes the alloy system system having no transformation point. In the non-oriented electrical steel sheet according to the present embodiment, it is necessary to appropriately increase the average grain diameter in the base, and the manufacturing of the non-oriented electrical steel sheet as the alloy system system having no transformation point is an effective method for increasing grain diameters. Therefore, the respective amounts of Si and Mn preferably satisfy a predetermined relationship so that the non-oriented electrical steel sheet becomes the alloy system system having no transformation point.

According to the present inventors' studies, the capability for accelerating the formation of austenite phase (in other words, an effect of negating the capability for accelerating the formation of ferrite phase) of Mn is considered to be approximately 0.5 times the capability for accelerating the formation of ferrite phase of Si. Therefore, the equivalent amount of the capability for accelerating the formation of ferrite phase in the present embodiment can be expressed as "Si−0.5×Mn" based on the Si content.

In a case where the value of Si−0.5×Mn is less than 2.0%, the non-oriented electrical steel sheet becomes the alloy system system having a transformation point. As a result, during a high-temperature treatment in the manufacturing process, the metallographic structure of the steel sheet does not become a ferrite single phase, and there is a concern that the magnetic properties of the non-oriented electrical steel sheet may be degraded. Therefore, the value of Si−0.5×Mn is set to 2.0% or more and is preferably 2.1% or more.

Meanwhile, the upper limit value of Si−0.5×Mn is not particularly regulated, but the value of Si−0.5×Mn is not exceeding 3.4% due to the ranges of the Si content and the Mn content in the non-oriented electrical steel sheet according to the present embodiment. Therefore, the upper limit value of Si−0.5×Mn becomes substantially 3.4%.

Hitherto, the chemical composition of the base in the non-oriented electrical steel sheet according to the present embodiment has been described in detail.

In a case where the chemical composition of the base in the non-oriented electrical steel sheet is measured afterwards, it is possible to use a variety of well-known measurement methods. For example, spark discharge emission spectrometry method or ICP light emission analysis method may be used, in a case where C and S are accurately measured, combustion-infrared absorption method may be used, and in a case where O and N are accurately measured, inert gas melting-infrared absorption method/thermal conductivity method, or the like may be appropriately used.

<Regarding Sheet Thickness of Base>

The sheet thickness (the thickness tin FIG. 1) of the base 11 in the non-oriented electrical steel sheet 10 according to the present embodiment is preferably set to 0.40 mm or less in order to decrease high-frequency iron loss by decreasing eddy-current loss. Meanwhile, in a case where the sheet thickness t of the base 11 is less than 0.10 mm, the sheet thickness is thin, and thus there is a possibility that the threading of an annealing line may become difficult. Therefore, the sheet thickness t of the base 11 in the non-oriented electrical steel sheet 10 is preferably set to 0.10 mm or more and 0.40 mm or less. The sheet thickness t of the base 11 in the non-oriented electrical steel sheet 10 is more preferably 0.15 mm or more and 0.35 mm or less.

Hitherto, the base 11 in the non-oriented electrical steel sheet 10 according to the present embodiment has been described in detail.

<Regarding Insulating Coating>

Subsequently, an insulating coating 13 that the non-oriented electrical steel sheet 10 according to the present embodiment preferably has will be simply described.

In order to improve the magnetic properties of the non-oriented electrical steel sheet, it is important to decrease iron loss. The iron loss is configured of eddy-current loss and hysteresis loss. When the insulating coating 13 is provided on a surface of the base 11, it becomes possible to suppress electrical conduction between the electrical steel sheets laminated as an iron core and decrease the eddy-current loss of the iron core, and thus it becomes possible to further improve the practical magnetic properties of the non-oriented electrical steel sheet 10.

Here, the insulating coating 13 that the non-oriented electrical steel sheet 10 according to the present embodiment includes is not particularly limited as long as the insulating coating can be used as an insulating coating for non-oriented electrical steel sheets, and it is possible to use well-known insulating coatings. As the above-described insulating coating, for example, composite insulating coatings mainly composed of an inorganic substance as main component and further including an organic substance can be mentioned. Here, the composite insulating coating refers to an insulating coating which includes at least any inorganic substance, for example, a chromic acid metal salt, a phosphoric acid metal salt, a colloidal silica, a Zr compound, a Ti compound, or the like as main component and in which fine particles of an organic resin are dispersed. Particularly, from the viewpoint of decreasing in environmental loads during manufacturing, which has been increasingly required in recent years, insulating coatings for which a phosphoric acid metal salt, a Zr or Ti coupling agent, or a carbonate or ammonium salt thereof is used as a starting material are preferably used.

The attachment amount of the insulating coating 13 as described above is not particularly limited, but is preferably set to, for example, 0.1 $g/m^2$ or more and 2.0 $g/m^2$ or less per one side of surface and more preferably set to 0.3 $g/m^2$ or more and 1.5 $g/m^2$ or less per one side of surface. When the insulating coating 13 is formed so as to obtain the above-described attachment amount, it becomes possible to hold excellent uniformity. In a case where the attachment amount of the insulating coating 13 is measured afterwards, it is possible to use a variety of well-known measurement methods. The attachment amount of the insulating coating 13 can be calculated from, for example, a difference in mass before and after the removal of the insulating coating 13 by immersing the non-oriented electrical steel sheet 10 with the insulating coating 13 formed in a thermal alkali solution to remove only the insulating coating 13.

<Regarding Method for Measuring Magnetic Properties of Non-Oriented Electrical Steel Sheet>

The non-oriented electrical steel sheet 10 according to the present embodiment has the above-described structure and thus exhibits excellent magnetic properties. Here, a variety of magnetic properties exhibited by the non-oriented electrical steel sheet 10 according to the present embodiment can be measured on the basis of the Epstein method regulated in JIS C2550 or a single sheet magnetic properties measurement method (single sheet tester: SST) regulated in JIS C2556.

Hitherto, the non-oriented electrical steel sheet 10 according to the present embodiment has been described in detail with reference to FIG. 1.

(Regarding Method for Manufacturing Non-Oriented Electrical Steel Sheet)

Subsequently, a preferred method for manufacturing the non-oriented electrical steel sheet 10 according to the present embodiment as described above will be simply described with reference to FIG. 2.

Figure 2:
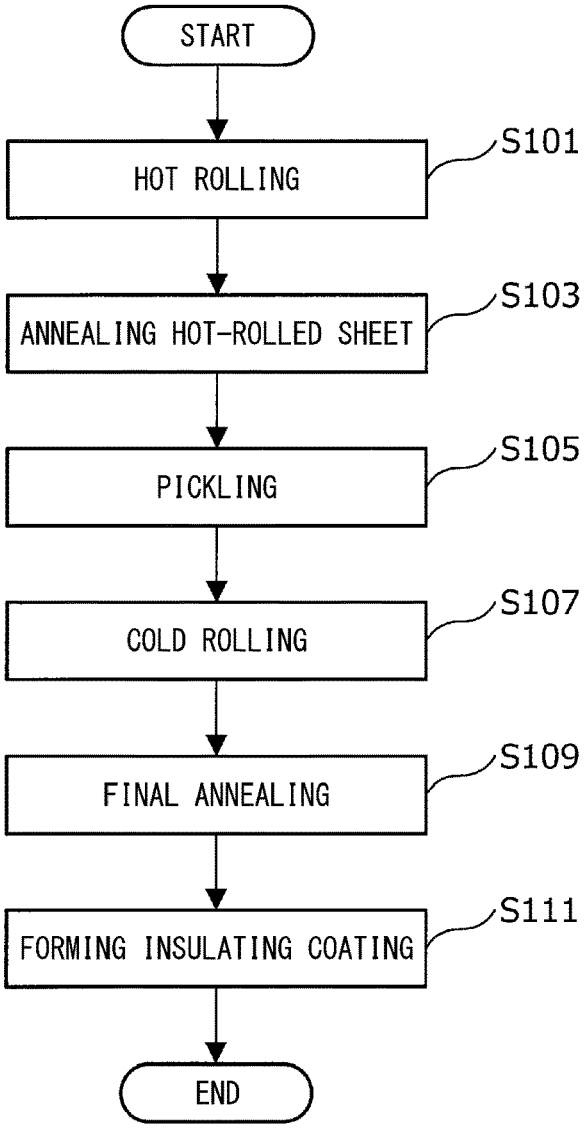
FIG. 2 is a view showing an example of a flow of a method for manufacturing the non-oriented electrical steel sheet according to the same embodiment.

FIG. 2 is a view showing an example of the flow of the method for manufacturing the non-oriented electrical steel sheet according to the present embodiment.

In the method for manufacturing the non-oriented electrical steel sheet 10 according to the present embodiment, hot rolling, annealing of hot-rolled sheet, pickling, cold rolling, and final annealing are sequentially carried out on a steel ingot having a predetermined chemical composition as described above. In addition, in a case where the insulating coating 13 is formed on the surface of base 11, the insulating coating is formed after the final annealing. Hereinafter, individual steps carried out in the method for manufacturing the non-oriented electrical steel sheet 10 according to the present embodiment will be described in detail.

<Hot Rolling Step>

In the method for manufacturing the non-oriented electrical steel sheet according to the present embodiment, first, a steel ingot (slab) having the above-described chemical composition is heated, and the heated steel ingot is hot-rolled, thereby obtaining a hot-rolled steel sheet (Step S101). Although the heating temperature of the steel ingot that is subjected to hot rolling is not particularly regulated, for example, is preferably set to 1,050° C. to 1,300° C. The heating temperature of the steel ingot is more preferably 1,050° C. to 1,250° C.

In addition, although the sheet thickness of the hot-rolled steel sheet after the hot rolling is not particularly regulated, for example, is preferably set to approximately 1.6 mm to 3.5 mm in consideration of the final sheet thickness of the base. The hot rolling step is preferably ended while the temperature of the steel sheet is in a range of 700° C. to 1,000° C. The hot rolling-end temperature is more preferably 750° C. to 950° C.

<Annealing Hot-Rolled Sheet Step>

After the hot rolling, annealing of hot-rolled sheet (annealing on the hot-rolled steel sheet) is carried out (Step S103). In a case of continuous annealing, with respect to the hot-rolled steel sheet, for example, annealing at 750° C. to 1,200° C. including soaking for 10 seconds to 10 minutes is preferably carried out. In addition, in a case of box annealing, with respect to the hot-rolled steel sheet, for example, annealing at 650° C. to 950° C. including soaking for 30 minutes to 24 hours is preferably carried out.

The annealing hot-rolled sheet step may not be carried out in order for cost reduction although the magnetic properties slightly deteriorate compared to a case in which the annealing hot-rolled sheet step is carried out.

<Pickling Step>

After the annealing hot-rolled sheet step, pickling is carried out (Step S105). Therefore, a scale layer including an oxide as main component which is formed on the surface of the steel sheet during annealing the hot-rolled sheet is removed. In a case where the hot-rolled sheet is treated by box annealing, the pickling step is preferably carried out before annealing the hot-rolled sheet from the viewpoint of descaling property.

<Cold Rolling Step>

After the pickling step (also after the annealing hot-rolled sheet step in a case where annealing the hot-rolled sheet is carried out by box annealing), on the hot-rolled steel sheet, cold rolling is carried out (Step S107). In the cold rolling, the pickled sheet from which the scale has been removed is preferably rolled at a rolling reduction that the final sheet thickness of the base becomes 0.10 mm to 0.40 mm.

<Final Annealing Step>

After the cold rolling step, with respect to the cold-rolled steel sheet obtained by the cold rolling step, final annealing is carried out (Step S109). In the method for manufacturing the non-oriented electrical steel sheet according to the present embodiment, the temperature rising process in the final annealing is preferably rapid heating. When the heating in the temperature rising process is carried out rapidly, a recrystallization texture advantageous to the magnetic properties is formed in the base 11. In a case where the temperature rising process in the final annealing is rapid heating, the final annealing is preferably carried out by continuous annealing.

Specifically, in the temperature rising process, the average temperature rising rate is preferably set to 1° C./second to 2,000° C./second. In addition, the atmosphere in the furnace during the temperature rising is preferably set to a mixed atmosphere of $H_2$ and $N_2$ (that is, $H_2+N_2=100$ volume %) in which the fraction of $H_2$ is 10 volume % to 100 volume %, and the dew point of the atmosphere is preferably set to 30° C. or lower. The average temperature rising rate is more preferably 5° C./second to 1,500° C./second, and the fraction of $H_2$ in the atmosphere is more preferably 15 volume % to 90 volume %, and the dew point of the atmosphere is more preferably 20° C. or lower and still more preferably 10° C. or lower. The above-described average heating speed can be realized using direct heating or indirect heating in which a radiant tube is used or using other well-known heating method such as energization heating or induction heating in a case of heating by gas combustion.

In the soaking process after the temperature rising process, it is preferable that the soaking temperature is set to 700° C. to 1,100° C., the soaking time is set to 1 second to 300 seconds, the atmosphere is set to a mixed atmosphere of $H_2$ and $N_2$ (that is, $H_2+N_2=100$ volume %) in which the fraction of $H_2$ is 10 volume % to 100 volume %, and the dew point of the atmosphere is set to 20° C. or lower. The soaking temperature is more preferably 750° C. to 1,050° C., and the fraction of $H_2$ in the atmosphere is more preferably 15 volume % to 90 volume %, and the dew point of the atmosphere is more preferably 10° C. or lower and still more preferably 0° C. or lower.

In the cooling process after the soaking process, the cold-rolled steel sheet is preferably cooled to 200° C. or lower at an average cooling rate of 1° C./second to 50° C./second. The average cooling rate is more preferably 5° C./second to 30° C./second.

According to the manufacturing method including the respective processes described above, it is possible to manufacture the non-oriented electrical steel sheet 10 according to the present embodiment.

<Forming Insulating Coating Step>

After the final annealing, forming insulating coating step is carried out as necessary (Step S111). The forming insulating coating step is not particularly limited, and coating and drying a treatment liquid may be carried out by a well-known method using a well-known insulating coating treatment liquid as described above.

On the surface of the base on which the insulating coating is to be formed, an arbitrary pretreatment such as degreasing using an alkali or the like or a pickling treatment using hydrochloric acid, sulfuric acid, phosphoric acid, or the like may be carried out before coating the treatment liquid. Coating and drying the treatment liquid may be carried out on the surface that has been subjected to the final annealing without carrying out the pretreatment.

Hitherto, the method for manufacturing the non-oriented electrical steel sheet according to the present embodiment has been described in detail with reference to FIG. 2.

EXAMPLES

Hereinafter, the non-oriented electrical steel sheet according to the present invention will be specifically described while describing examples. Examples described below are simply an example of the non-oriented electrical steel sheet according to the present embodiment, and the non-oriented electrical steel sheet according to the present invention is not limited to the following examples.

Experiment Example 1

Steel slabs containing a composition shown in Table 1 below with a remainder consisting of Fe and impurities were heated to 1,150° C. and then rolled to a thickness of 2.0 mm by hot rolling. Subsequently, the hot-rolled steel sheets were annealed at a soaking temperature of 1,000° C. for a soaking time of 40 seconds in an annealing furnace of continuous annealing-type and then cold-rolled, thereby producing cold-rolled steel sheets having thickness of 0.25 mm With respect to these cold-rolled steel sheets, final annealing was carried out at a soaking temperature of 1,000° C. for a soaking time of 15 seconds. After that, furthermore, a solution including a phosphoric acid metal salt as main component and including an emulsion of an acrylic resin was applied and baked to both surfaces of the steel sheets to form composite insulating coatings, thereby manufacturing non-oriented electrical steel sheets.

The final annealing was carried out at a dew point of −30° C. in a mixed atmosphere of $H_2$ and $N_2$ in which the fraction of $H_2$ was 30 volume % in the temperature rising process and the soaking process. In addition, the average temperature rising rate in the temperature rising process during the final annealing was set to 200° C./second, and the average cooling rate in the cooling process was set to 20° C./second. After the final annealing, the cold-rolled steel sheets were cooled to 200° C. or lower.

In Table 1, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are summarized in Table 1.

TABLE 1

| Test | Composition of steel slab (mass %) | | | | | | | | | | | | | |
|---|---|---|---|---|---|---|---|---|---|---|---|---|---|---|
| Number | C | Si | Mn | P | S | sol. Al | N | Ti | La | Ce | Pr | Nd | Sn | Sb |
| 1 | 0.0026 | 3.6 | 2.2 | 0.008 | 0.0032 | 0.0021 | 0.0015 | 0.0025 | Tr. | Tr. | Tr. | Tr. | 0.023 | Tr. |
| 2 | 0.0027 | 3.6 | 2.2 | 0.008 | 0.0032 | 0.0022 | 0.0015 | 0.0024 | 0.0038 | Tr. | Tr. | Tr. | 0.023 | Tr. |
| 3 | 0.0025 | 3.6 | 2.2 | 0.008 | 0.0031 | 0.0019 | 0.0014 | 0.0035 | Tr. | 0.0040 | Tr. | Tr. | 0.022 | Tr. |
| 4 | 0.0025 | 3.6 | 2.2 | 0.008 | 0.0032 | 0.0018 | 0.0014 | 0.0032 | Tr. | Tr. | 0.0040 | Tr. | 0.022 | Tr. |
| 5 | 0.0024 | 3.6 | 2.2 | 0.008 | 0.0032 | 0.0017 | 0.0013 | 0.0030 | Tr. | Tr. | Tr. | 0.0042 | 0.023 | Tr. |
| 6 | 0.0025 | 3.6 | 2.2 | 0.008 | 0.0031 | 0.0018 | 0.0014 | 0.0028 | 0.0012 | 0.0022 | 0.0003 | 0.0006 | 0.022 | Tr. |
| 7 | 0.0026 | 3.6 | 2.2 | 0.008 | 0.0017 | 0.0023 | 0.0014 | 0.0025 | 0.0008 | 0.0017 | Tr. | Tr. | 0.022 | Tr. |
| 8 | 0.0027 | 3.6 | 2.2 | 0.008 | 0.0017 | 0.0022 | 0.0013 | 0.0250 | Tr. | 0.0024 | Tr. | Tr. | 0.022 | Tr. |
| 9 | 0.0027 | 3.6 | 2.2 | 0.008 | 0.0017 | 0.0022 | 0.0015 | 0.0023 | 0.0008 | 0.0017 | Tr. | Tr. | 0.023 | Tr. |
| 10 | 0.0026 | 3.6 | 2.2 | 0.008 | 0.0026 | 0.0012 | 0.0015 | 0.0033 | 0.0014 | 0.0020 | 0.0003 | 0.0005 | 0.023 | Tr. |
| 11 | 0.0025 | 3.6 | 2.2 | 0.008 | 0.0025 | 0.0011 | 0.0015 | 0.0030 | Tr. | Tr. | Tr. | Tr. | 0.025 | Tr. |

| Test Number | Composition of steel slab (mass %) Ca | Mg | La + Ce + Pr + Nd | Si − 0.5 × Mn | Si + 0.5 × Mn | $W_{10/400}$ (W/kg) | $B_{50LC}$ (T) | Note |
|---|---|---|---|---|---|---|---|---|
| 1 | 0.0003 | Tr. | Tr. | 2.5 | 4.7 | 12.1 | 1.63 | Comparative Example |
| 2 | 0.0028 | Tr. | 0.0038 | 2.5 | 4.7 | 11.1 | 1.65 | Invention Example |
| 3 | 0.0028 | Tr. | 0.0040 | 2.5 | 4.7 | 11.1 | 1.65 | Invention Example |
| 4 | 0.0030 | Tr. | 0.0040 | 2.5 | 4.7 | 11.0 | 1.65 | Invention Example |
| 5 | 0.0030 | Tr. | 0.0042 | 2.5 | 4.7 | 11.0 | 1.65 | Invention Example |
| 6 | 0.0030 | Tr. | 0.0043 | 2.5 | 4.7 | 11.0 | 1.65 | Invention Example |
| 7 | 0.0015 | Tr. | 0.0025 | 2.5 | 4.7 | 10.9 | 1.65 | Invention Example |
| 8 | 0.0016 | Tr. | 0.0024 | 2.5 | 4.7 | 13.0 | 1.63 | Comparative Example |
| 9 | 0.0002 | Tr. | 0.0025 | 2.5 | 4.7 | — | — | Comparative Example |
| 10 | 0.0030 | Tr. | 0.0042 | 2.5 | 4.7 | 11.0 | 1.65 | Invention Example |
| 11 | 0.0030 | Tr. | Tr. | 2.5 | 4.7 | 12.0 | 1.63 | Comparative Example |

As is clear from Table 1, Test Number 1 in which the total amount of La, Ce, Pr, and Nd and the Ca content were below the range of the present invention, Test Number 8 in which the Ti content was above the range of the present invention, and Test Number 11 in which the total amount of La, Ce, Pr, and Nd was below the range of the present invention were poor in the iron loss and the density of magnetic flux. In addition, in Test Number 9 in which the Ca content was below the range of the present invention, a nozzle was blocked during continuous casting, and thus the manufacturing of a non-oriented electrical steel sheet was given up. On the other hand, Test Numbers 2, 3, 4, 5, 6, 7, and 10 in which the chemical compositions of the steel sheets were in the range of the present invention were excellent in both the iron loss and the density of magnetic flux.

Experiment Example 2

Steel slabs containing a composition shown in Table 2 with a remainder consisting of Fe and impurities were heated to 1,150° C. and then rolled to a thickness of 2.0 mm by hot rolling. Subsequently, the hot-rolled steel sheets were annealed in an annealing furnace of continuous annealing-type under conditions in which the soaking temperature was 1,000° C. and the soaking time was 40 seconds and then cold-rolled, thereby obtaining cold-rolled steel sheets having thickness of 0.25 mm. After that, with respect to these cold-rolled steel sheets, final annealing was carried out under conditions in which the soaking temperature was 1,000° C. and a soaking time was 15 seconds. After that, furthermore, a solution including a phosphoric acid metal salt as main component and including an emulsion of an acrylic resin was applied and baked to both surfaces of the steel sheets to form composite insulating coatings, thereby manufacturing non-oriented electrical steel sheets.

Here, the final annealing was carried out at an atmosphere dew point of −30° C. in a mixed atmosphere of $H_2$ and $N_2$ in which the fraction of $H_2$ was 20 volume % in the temperature rising process and the soaking process. In addition, the average temperature rising rate in the temperature rising process during the final annealing was set to 20° C./second, and the average cooling rate in the cooling process was set to 20° C./second. After the final annealing, the cold-rolled steel sheets were cooled to 200° C. or lower.

In Table 2, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are also summarized in Table 2.

TABLE 2

| Test | Composition of steel slab (mass %) | | | | | | | | | | | | | |
|---|---|---|---|---|---|---|---|---|---|---|---|---|---|---|
| Number | C | Si | Mn | P | S | sol. Al | N | Ti | La | Ce | Pr | Nd | Sn | Sb |
| 12 | 0.0020 | 3.6 | 2.8 | 0.005 | 0.0014 | 0.0015 | 0.0016 | 0.0033 | Tr. | Tr. | Tr. | 0.0015 | Tr. | Tr. |
| 13 | 0.0025 | 3.6 | 2.8 | 0.008 | 0.0029 | 0.0010 | 0.0017 | 0.0032 | 0.0007 | 0.0015 | Tr. | 0.0003 | Tr. | Tr. |
| 14 | 0.0024 | 3.6 | 2.8 | 0.055 | 0.0013 | 0.0009 | 0.0016 | 0.0033 | Tr. | Tr. | Tr. | 0.0016 | Tr. | Tr. |
| 15 | 0.0018 | 3.5 | 2.7 | 0.009 | 0.0007 | 0.0009 | 0.0015 | 0.0022 | 0.0006 | 0.0010 | Tr. | Tr. | 0.012 | Tr. |
| 16 | 0.0022 | 3.5 | 2.7 | 0.008 | 0.0025 | 0.0015 | 0.0017 | 0.0011 | 0.0008 | 0.0012 | 0.0002 | 0.0004 | 0.025 | Tr. |
| 17 | 0.0025 | 3.5 | 2.7 | 0.008 | 0.0026 | 0.0058 | 0.0018 | 0.0012 | 0.0009 | 0.0011 | 0.0002 | 0.0004 | 0.026 | Tr. |
| 18 | 0.0021 | 3.4 | 2.6 | 0.007 | 0.0019 | 0.0008 | 0.0013 | 0.0032 | 0.0009 | 0.0016 | Tr. | Tr. | 0.032 | Tr. |
| 19 | 0.0024 | 3.4 | 2.6 | 0.008 | 0.0032 | 0.0013 | 0.0016 | 0.0023 | 0.0010 | 0.0015 | 0.0003 | 0.0006 | 0.051 | Tr. |
| 20 | 0.0027 | 3.4 | 2.6 | 0.010 | 0.0021 | 0.0012 | 0.0015 | 0.0023 | 0.0008 | 0.0016 | Tr. | Tr. | Tr. | 0.030 |
| 21 | 0.0024 | 3.4 | 3.2 | 0.008 | 0.0024 | 0.0011 | 0.0015 | 0.0025 | 0.0008 | 0.0016 | Tr. | Tr. | Tr. | 0.031 |
| 22 | 0.0023 | 3.9 | 3.6 | 0.007 | 0.0020 | 0.0010 | 0.0015 | 0.0024 | 0.0007 | 0.0013 | Tr. | Tr. | 0.026 | Tr. |
| 23 | 0.0029 | 4.2 | 2.6 | 0.007 | 0.0020 | 0.0012 | 0.0018 | 0.0024 | 0.0008 | 0.0014 | Tr. | Tr. | 0.027 | Tr. |
| 24 | 0.0020 | 3.2 | 2.3 | 0.013 | 0.0015 | 0.0010 | 0.0022 | 0.0021 | 0.0006 | 0.0010 | Tr. | 0.0003 | 0.029 | Tr. |
| 25 | 0.0012 | 3.7 | 1.6 | 0.008 | 0.0020 | 0.0012 | 0.0014 | 0.0018 | 0.0008 | 0.0010 | Tr. | Tr. | 0.025 | Tr. |
| 26 | 0.0038 | 3.7 | 1.6 | 0.006 | 0.0022 | 0.0009 | 0.0012 | 0.0019 | 0.0007 | 0.0010 | Tr. | Tr. | 0.026 | Tr. |

| Test Number | Composition of steel slab (mass %) Ca | Mg | La + Ce + Pr + Nd | Si − 0.5 × Mn | Si + 0.5 × Mn | $W_{10/400}$ (W/kg) | $B_{50LC}$ (T) | Note |
|---|---|---|---|---|---|---|---|---|
| 12 | 0.0015 | Tr. | 0.0015 | 2.2 | 5.0 | 10.4 | 1.64 | Invention Example |
| 13 | 0.0021 | 0.0010 | 0.0025 | 2.2 | 5.0 | 10.4 | 1.64 | Invention Example |
| 14 | 0.0014 | Tr. | 0.0016 | 2.2 | 5.0 | — | — | Comparative Example |
| 15 | 0.0012 | Tr. | 0.0016 | 2.2 | 4.9 | 10.6 | 1.65 | Invention Example |
| 16 | 0.0025 | Tr. | 0.0026 | 2.2 | 4.9 | 10.5 | 1.65 | Invention Example |
| 17 | 0.0024 | Tr. | 0.0026 | 2.2 | 4.9 | 12.0 | 1.63 | Comparative Example |
| 18 | 0.0018 | Tr. | 0.0025 | 2.1 | 4.7 | 11.0 | 1.65 | Invention Example |
| 19 | 0.0032 | Tr. | 0.0034 | 2.1 | 4.7 | 10.9 | 1.66 | Invention Example |
| 20 | 0.0020 | Tr. | 0.0024 | 2.1 | 4.7 | 10.9 | 1.66 | Invention Example |
| 21 | 0.0024 | Tr. | 0.0024 | 1.8 | 5.0 | 12.1 | 1.62 | Comparative Example |
| 22 | 0.0022 | Tr. | 0.0020 | 2.1 | 5.7 | 12.3 | 1.61 | Comparative Example |
| 23 | 0.0020 | 0.0022 | 0.0022 | 2.9 | 5.5 | — | — | Comparative Example |
| 24 | 0.0013 | Tr. | 0.0019 | 2.1 | 4.4 | 11.3 | 1.66 | Invention Example |

TABLE 2-continued

| | | | | | | | | |
|---|---|---|---|---|---|---|---|---|
| 25 | 0.0015 | Tr. | 0.0018 | 2.9 | 4.5 | 10.8 | 1.66 | Invention Example |
| 26 | 0.0016 | Tr. | 0.0017 | 2.9 | 4.5 | 11.0 | 1.65 | Invention Example |

As for Test Number 14 in which the P content was above the range of the present invention and Test Number 23 in which the Si content was above the range of the present invention broke during the cold rolling, and thus the magnetic measurement was not possible. In Test Numbers 12, 13, 15, 16, 18, 19, 20, 24, 25, and 26 in which the chemical compositions of the steel sheets were in the range of the present invention, the cold rolling was possible, and the iron losses and the densities of magnetic flux were excellent. Meanwhile, Test Number 17 in which the amount of sol. Al was above the range of the present invention was poor in the iron loss than Test Number 16 in which the composition was almost the same except for sol. Al and which is in the scope of the present invention. In addition, Test Number 22 in which the Mn content was above the range of the present invention was poor in the iron loss and the density of magnetic flux. In addition, Test Number 21 in which Si−0.5× Mn was below the range of the present invention was poor in the iron loss and the density of magnetic flux.

Experiment Example 3

Steel slabs containing a composition shown in Table 3 below with a remainder consisting of Fe and impurities were heated to 1,150° C. and then rolled to a thickness of 2.0 mm by hot rolling. Subsequently, the hot-rolled steel sheets were annealed in an annealing furnace of continuous annealing-type under conditions in which the soaking temperature was 1,000° C. and the soaking time was 40 seconds and then cold-rolled, thereby obtaining cold-rolled steel sheets having thickness of 0.25 mm. After that, with respect to these cold-rolled steel sheets, final annealing was carried out under conditions in which the soaking temperature was 800° C. and a soaking time was 15 seconds. After that, a solution including a phosphoric acid metal salt as main component and including an emulsion of an acrylic resin was applied and baked to both surfaces of the steel sheets to form composite insulating coatings, thereby manufacturing non-oriented electrical steel sheets. Subsequently, on the steel sheets, annealing for relieving stress of 750° C. for 2 hr was carried out.

Here, the final annealing was carried out at an atmosphere dew point of −30° C. in a mixed atmosphere of $H_2$ and $N_2$ in which the fraction of $H_2$ was 20 volume % in the temperature rising process and the soaking process. In addition, the average temperature rising rate in the temperature rising process during the final annealing was set to 15° C./second, and the average cooling rate in the cooling process was set to 15° C./second. After the final annealing, the cold-rolled steel sheets were cooled to 200° C. or lower.

In Table 3, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are summarized in Table 3.

TABLE 3

| Test | Composition of steel slab (mass %) | | | | | | | | | | | | | |
|---|---|---|---|---|---|---|---|---|---|---|---|---|---|---|
| Number | C | Si | Mn | P | S | sol. Al | N | Ti | La | Ce | Pr | Nd | Sn | Sb |
| 27 | 0.0023 | 3.8 | 1.7 | 0.008 | 0.0028 | 0.0012 | 0.0020 | 0.0032 | 0.0008 | 0.0017 | 0.0003 | 0.0005 | 0.032 | Tr. |
| 28 | 0.0024 | 3.8 | 1.7 | 0.008 | 0.0027 | 0.0010 | 0.0009 | 0.0012 | 0.0010 | 0.0021 | Tr. | 0.0003 | 0.030 | Tr. |
| 29 | 0.0024 | 3.8 | 1.7 | 0.008 | 0.0027 | 0.0011 | 0.0019 | 0.0030 | Tr. | Tr. | Tr. | Tr. | 0.032 | Tr. |
| 30 | 0.0023 | 3.0 | 1.3 | 0.008 | 0.0027 | 0.0010 | 0.0015 | 0.0020 | 0.0008 | 0.0019 | Tr. | Tr. | 0.030 | Tr. |
| 31 | 0.0025 | 3.3 | 1.3 | 0.007 | 0.0026 | 0.0009 | 0.0016 | 0.0022 | 0.0009 | 0.0019 | Tr. | Tr. | 0.028 | Tr. |
| 32 | 0.0022 | 3.3 | 1.5 | 0.009 | 0.0035 | 0.0010 | 0.0025 | 0.0035 | 0.0026 | 0.0032 | 0.0004 | 0.0013 | 0.028 | Tr. |

| Test Number | Composition of steel slab (mass %) Ca | Mg | La + Ce + Pr + Nd | Si − 0.5 × Mn | Si + 0.5 × Mn | $W_{10/400}$ (W/kg) | $B_{50LC}$ (T) | Note |
|---|---|---|---|---|---|---|---|---|
| 27 | 0.0026 | Tr. | 0.0033 | 3.0 | 4.7 | 9.4 | 1.64 | Invention Example |
| 28 | 0.0030 | Tr. | 0.0034 | 3.0 | 4.7 | 9.6 | 1.65 | Invention Example |
| 29 | 0.0003 | Tr. | Tr. | 3.0 | 4.7 | 11.4 | 1.62 | Comparative Example |
| 30 | 0.0028 | Tr. | 0.0027 | 2.4 | 3.7 | 11.5 | 1.66 | Comparative Example |
| 31 | 0.0030 | Tr. | 0.0028 | 2.7 | 4.0 | 10.3 | 1.66 | Invention Example |
| 32 | 0.0035 | Tr. | 0.0075 | 2.6 | 4.1 | 10.5 | 1.65 | Invention Example |

The magnetic properties of the non-oriented electrical steel sheets of individual test numbers of Experiment Example 3 were generally improved by carrying out the annealing for relieving stress compared to a case in which annealing for relieving stress was not carried out, and, particularly, Test Numbers 27, 28, 31, and 32 in which the chemical compositions of the steel sheets were in the range of the present invention were excellent in the iron loss and the density of magnetic flux. On the other hand, Test Number 29 in which the total amount of La, Ce, Pr, and Nd and the Ca content were below the range of the present invention was poor in the iron loss and the density of magnetic flux than Test Number 27 in which the composition was almost the same except for La, Ce, Pr, Nd, and Ca. In addition, Test Number 30 in which Si+0.5×Mn deviated downward was poor in the iron loss. As described above, it has been clarified that, even in a case where annealing for relieving stress is carried out, the non-oriented electrical steel sheet according to the present invention improves in the magnetic properties.

Hitherto, the preferred embodiment of the present invention has been described in detail with reference to the accompanying drawings, but the present invention is not limited to the above-described examples. It is clear that a person having ordinary skill in the art to which the present invention belongs is capable of devising a variety of modification examples or correction examples within the scope of technical concept described in the claims, and it is needless to say that such examples are also understood to be in the technical scope of the present invention.

INDUSTRIAL APPLICABILITY

According to the present invention, a non-oriented electrical steel sheet having favorable cold rollability and excellent magnetic properties can be obtained, and thus the present invention is highly industrially available.

BRIEF DESCRIPTION OF THE REFERENCE SYMBOLS

10 NON-ORIENTED ELECTRICAL STEEL SHEET
11 BASE
13 INSULATING COATING

The invention claimed is:

1. A non-oriented electrical steel sheet comprising, as a chemical composition, by mass %,
C: more than 0% and 0.0050% or less;
Si: 3.0% to 4.0%;
Mn: 1.2% to 3.3%;
P: more than 0% and less than 0.030%;
S: more than 0% and 0.0050% or less;
sol. Al: more than 0% and 0.0040% or less;
N: more than 0% and 0.0040% or less;
one or more of La, Ce, Pr, and Nd: 0.0005% to 0.0200% in total;
Ca: 0.0005% to 0.0100%;
Ti: 0.0005% to 0.0100%;
Sn: 0% to 0.10%;
Sb: 0% to 0.10%;
Mg: 0% to 0.0100%; and
a remainder including Fe and impurities, wherein
Si−0.5×Mn:2.0% or more, and
Si+0.5×Mn:4.4% or more.

2. The non-oriented electrical steel sheet according to claim 1, comprising, as the chemical composition, one or two selected from the group consisting of:
Sn:0.005% to 0.10%; and
Sb:0.005% to 0.10%.

3. The non-oriented electrical steel sheet according to claim 1 comprising, as the chemical composition:
Mg:0.0005% to 0.0100%.

4. The non-oriented electrical steel sheet according to claim 2 comprising, as the chemical composition:
Mg:0.0005% to 0.0100%.

5. A non-oriented electrical steel sheet comprising, as a chemical composition, by mass %,
C:0.0020% to 0.0038%;
Si:3.0% to 3.8%;
Mn:1.3% to 3.2%;
P:0.005% to 0.013%;
S:0.0007% to 0.0035%;
sol. Al:0.0008% to 0.0023%;
N:0.0009% to 0.0025%;
one or more of La, Ce, Pr, and Nd:0.0015% to 0.0075% in total;
Ca:0.0012% to 0.0035%;
Ti:0.0011% to 0.0035%;
Sn:0% to 0.051%;
Sb:0% to 0.031%;
Mg:0% to 0.0022%; and
a remainder including Fe and impurities, wherein
Si−0.5×Mn:2.1% or more, and
Si+0.5×Mn:4.4% or more.

* * * * *